United States Patent [19]

Yoshikai et al.

[11] 4,165,705

[45] Aug. 28, 1979

[54] COUPLING MECHANISM FOR COUPLING TOGETHER A PUSHER TUG AND A BARGE

[75] Inventors: Tatsuki Yoshikai, Yokohama; Hisatomo Morito, Tokyo; Haruhito Tsuboi, Kawasaki, all of Japan

[73] Assignee: Nippon Kokan Kabushiki Kaisha, Tokyo, Japan

[21] Appl. No.: 837,997

[22] Filed: Sep. 29, 1977

[30] Foreign Application Priority Data

Sep. 29, 1976 [JP] Japan ..... 51-116064

[51] Int. Cl.[2] ..... B63B 21/58

[52] U.S. Cl. ..... 114/249

[58] Field of Search ..... 114/242, 246, 247, 248, 114/249, 250

[56] References Cited

U.S. PATENT DOCUMENTS 3,430,601 3/1969 Thompson ..... 114/249

FOREIGN PATENT DOCUMENTS 947726 7/1949 France ..... 114/248

483300 1/1973 U.S.S.R. ..... 114/249

*Primary Examiner*—Jesus D. Sotelo

*Attorney, Agent, or Firm*—Flynn & Frishauf

[57] ABSTRACT

The coupling mechanism comprises a pair of spaced connecting rods secured to the stern of a barge and apparatus mounted on the tug for receiving the connecting rods. The rod receiving apparatus comprises a pair of vertical circular disc members each having a diameter smaller than the spacing between the connecting rods. Contact members are secured to the peripheries of the circular disc members to form a V shaped groove therebetween for receiving the connecting rods. The circular disc members are urged toward each other by a spring, and stop members are provided to limit the rotational movement of the circular disc members. A cushion member is provided to absorb the shock created when the tug and barge are coupled together. Further, a holding device is provided for holding the coupling mechanism in an operative state or in an inoperative state.

12 Claims, 13 Drawing Figures

COUPLING MECHANISM FOR COUPLING TOGETHER A PUSHER TUG AND A BARGE

BACKGROUND OF THE INVENTION

This invention relates to a coupling mechanism between a pusher tug and a barge.

Methods are known for pushing a barge not provided with any propeller by a powered tug. Among various prior art coupling mechanisms between a pusher tug and a barge are included the single push rod—two wire system, the plural push rods—two wire system, the V notch system, and the V notch—pin system. These systems are not always satisfactory. More particularly, as shown in FIGS. 1A and 1B, in the single push rod—two wire system, an arcuate push rod 2 is secured to the bow of a tug 1 for engaging a thrust receiver 4 at the stern of a barge 3. The tug 1 and the barge 3 are tightly connected together by riggings 6 with one end pulled by a winch 5. This method of coupling prevents relative movement between the tug and barge in the fore and aft direction and in the left and right directions as well as relative swinging motion, but permits rolling, pitching and relative vertical movement. As shown in FIGS. 2A and 2B, in the plural push rod—two wire system two push rods 2 are secured to the bow of the pusher tug 1*a* for engaging a vertical surface 7 at the stern of a barge 3*a*. The tug and barge are coupled together by riggings 6 and winches 5 mounted on the pusher tug 1*a*. With this system the relative movements in the fore and aft, left and right and swinging in a horizontal plane are substantially precluded, but relative vertical motion, rolling and pitching are relatively free. Furthermore, in the V notch system shown in FIGS. 3A and 3B, the bow 8 of the pusher tug 1B is received in a V shaped notch 9 at the stern of a barge 3*b* with motor car tires or other cushion members 9 interposed therebetween. The tug and barge are connected together by riggings 6*b* made of nylon or other material that can elongate and contract to some extent. With this method of coupling, fore and aft, left and right and swing as well as rolling are prevented, whereas pitching and vertical relative movement are permitted. According to the V notch and pin system shown in FIGS. 4A and 4B the bow is received in the V shaped notch 9 but riggings and winch 5 shown in FIGS. 3A and 3B are not used. Lateral pins 10 projecting from the opposite sides of the tug are received in openings 10*a* on both sides of the V shaped notch 9 for interconnecting the tug and the barge. This method of coupling prevents relative movements of fore and aft, left and right, up and down, swinging and rolling but permits one component of the rotary movement caused by pitching.

The relative motions between the tug and the barge can be analyzed into six motions comprising three displacements of fore and aft, left and right and up and down and three rotational displacements of rolling, pitching and swinging, such analysis being possible depending upon which one of the six displacement movements is arrested. While no displacement occurs in the arrested direction, it is necessary to apply a substantial force to effect such arrest. Generally speaking, the force increases with the number of arrests. In the method of coupling utilizing connecting riggings as shown in FIGS. 1A to 3B it is troublesome to connect the riggings and with the increase in the size of the barge it becomes necessary to use strong riggings due to increased tension applied thereto. While the coupling system shown in FIGS. 2A and 2B, has a large freedom as above described, durability to waves is poor because no positive expedient has been made for permitting relative movement. The prior art coupling mechanisms described above conform to the prior art coupling systems described above and are subject to excessive force while they are maintained in a state of preventing specific relative movements between the tug and the barge. Some of them require the use of connecting riggings requiring troublesome connecting operation. For example, it has been proposed in U.S. Pat. No. 2,870,743 to steer a pusher tug and a barge to always sail them with their longitudinal axis aligned by detecting the deflection angle between them. However, it is necessary to provide riggings between both sides of two ships, thus not only complicating the construction but also requiring much time to engage and disengage the coupling mechanism. Where the barge is large, riggings having a large diameter are necessary which are difficult to handle.

SUMMARY OF THE INVENTION

It is an object of this invention to provide an improved coupling mechanism for coupling together a pusher tug and a barge having simple and compact construction and capable of coupling together the tug and the barge without using a winch and riggings.

Another object of the invention is to provide a novel coupling mechanism for a tug and a barge capable of preventing or relieving the effect of such relative movements of the tug and the barge as heaving, rolling, pitching and yawing.

Still another object of this invention is to provide a novel coupling mechanism for a pusher tug and a barge which can detect the angle of relative rotation therebetween and can use the detected relative rotational angle to steer the tug.

A further object of this invention is to provide an improved coupling mechanism for coupling together a barge and a pusher tug capable of withstanding the action of waves.

According to this invention, these and further objects can be accomplished by providing a coupling mechanism for coupling together a pusher tug and a barge comprising a pair of spaced connecting rods secured to the opposite sides of one end of either one of the tug and the barge, and receiving means mounted on one end of the other of the tug and the barge for receiving the connecting rods, said receiving means including two vertical circular disc members each having a diameter smaller than the spacing between the connecting rods, means for rotatably supporting the circular disc means, contact members secured to the peripheries of the circular disc members, said contact members being arranged to form a V shaped groove therebetween for receiving the connecting rods, means for urging the circular disc members toward each other, and stop members for limiting the rotational movement of the circular disc members.

DESCRIPTION OF THE PREFERRED EMBODIMENT

Figure 1A:
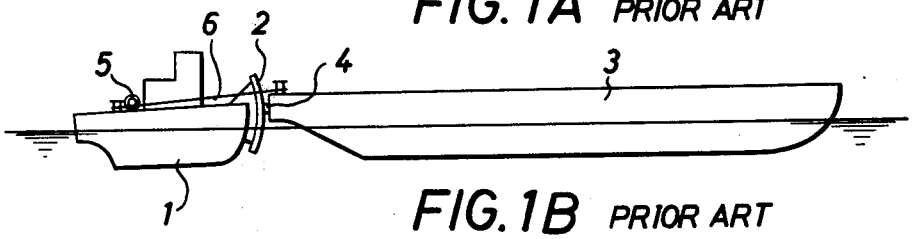
FIG. 1A PRIOR ART
FIG. 1A is a side view showing a prior art single push rod—two wire system of coupling together a pusher tug and a barge.
Figure 1B:
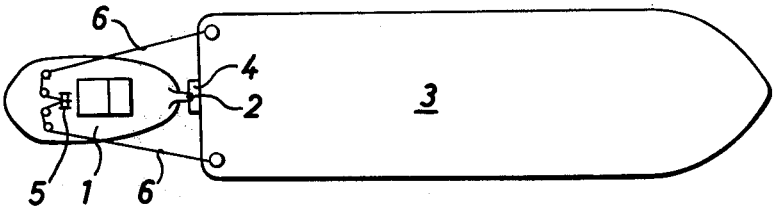
FIG. 1B PRIOR ART
FIG. 1B is a plan view of the coupling system shown in FIG. 1A.
Figure 2A:
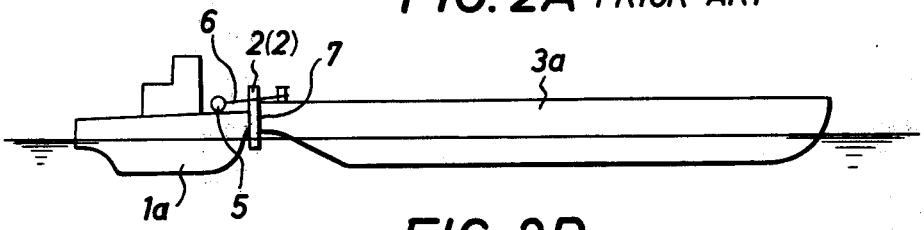
FIG. 2A PRIOR ART
FIG. 2A is a side view showing a prior art two push rods—two wire system of coupling.
Figure 2B:
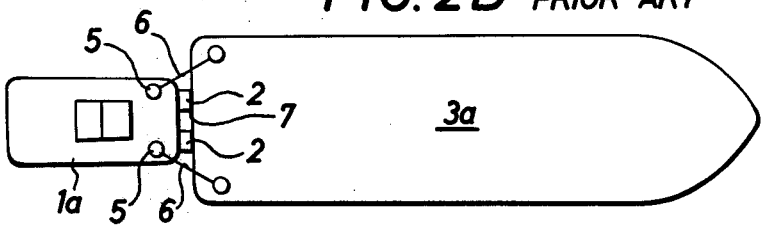
FIG. 2B PRIOR ART
FIG. 2B is a plan view of the coupling system shown in FIG. 2A.
Figure 3A:
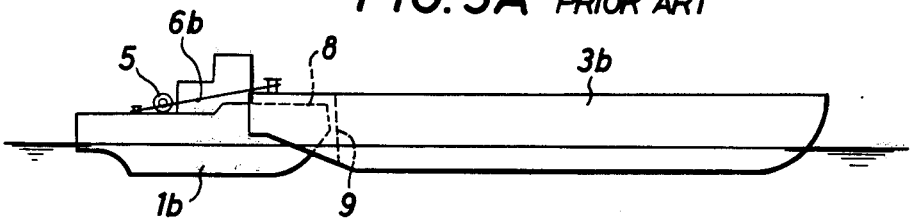
FIG. 3A PRIOR ART
FIG. 3A is a side view showing a prior art V notch system of coupling.
Figure 3B:
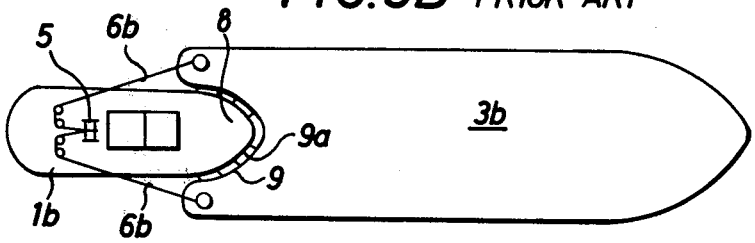
FIG. 3B PRIOR ART
FIG. 3B is a plan view of the coupling system shown in FIG. 3A.
Figure 4A:
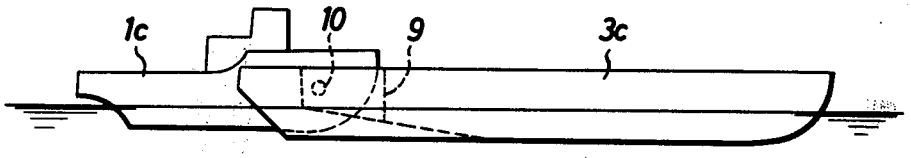
FIG. 4A PRIOR ART
FIG. 4A is a side view showing a prior art V notch—pin system of coupling.
Figure 4B:
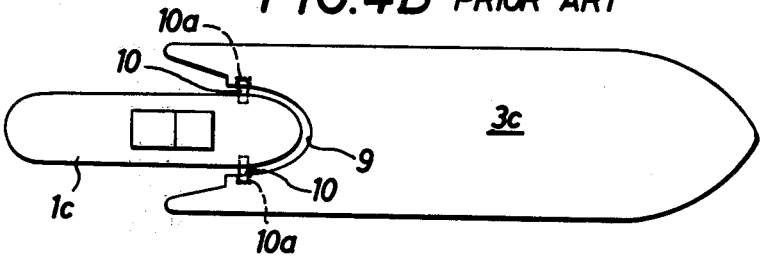
FIG. 4B PRIOR ART
FIG. 4B is a plan view of the coupling system shown in FIG. 4A.
Figure 5:
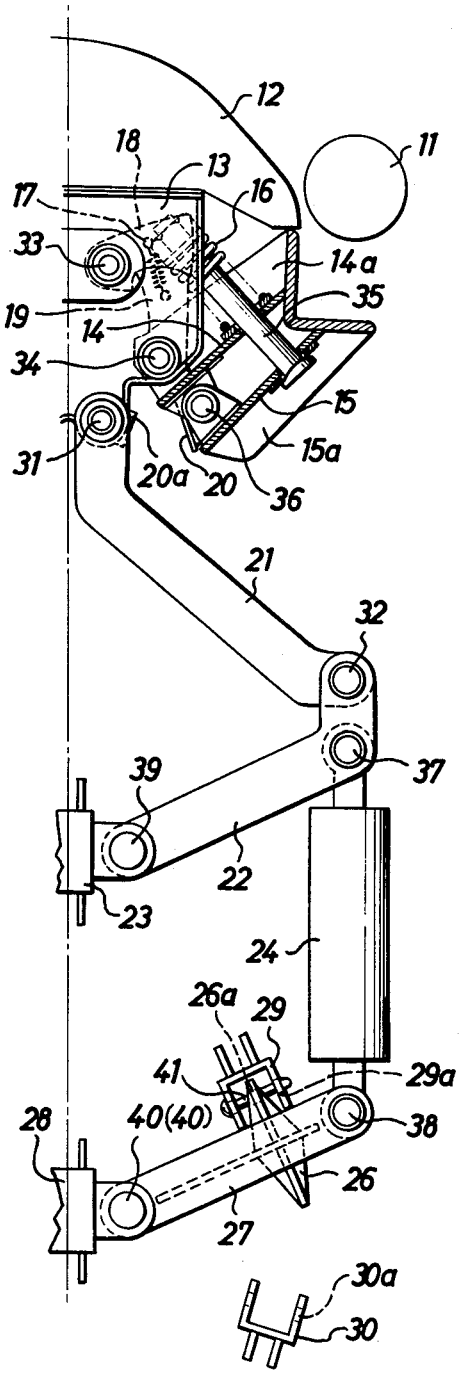
FIG. 5 is a plan view showing the righthand half of the coupling mechanism embodying the invention immediately prior to coupling.
Figure 6:
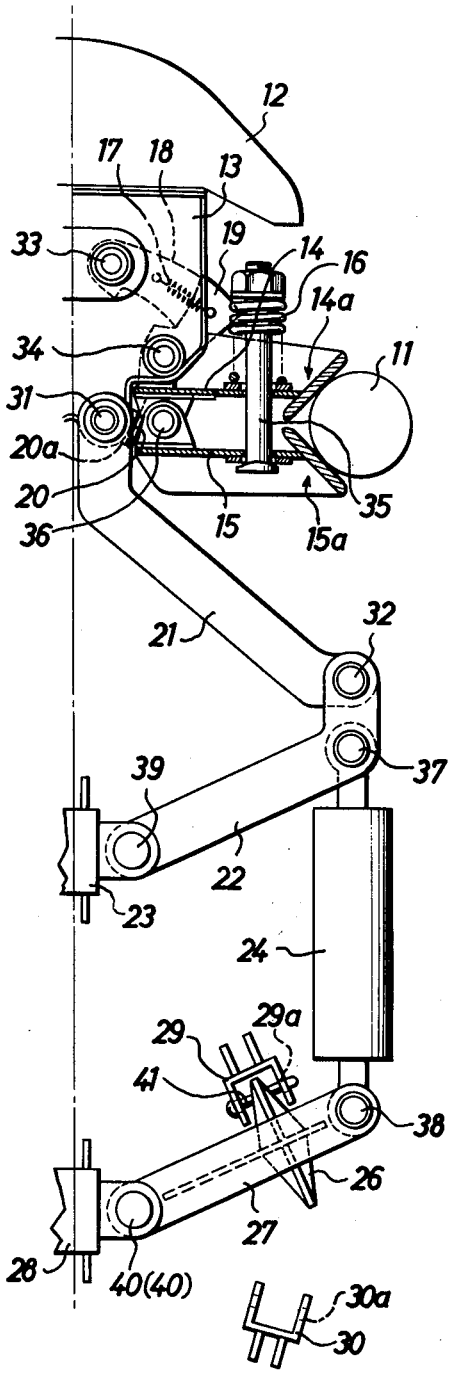
FIG. 6 is a plan view of the coupling mechanism shown in FIG. 5 after coupling.
Figure 7:
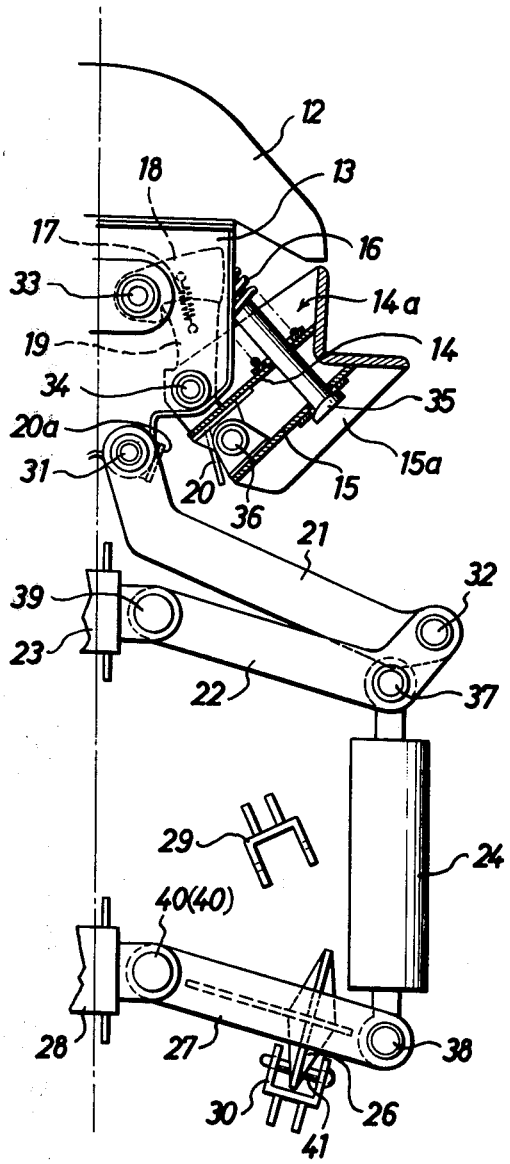
FIG. 7 is a plan view of the righthand half of the coupling mechanism shown in FIGS. 5 and 6 when the mechanism is held in the retracted position.
Figure 8:
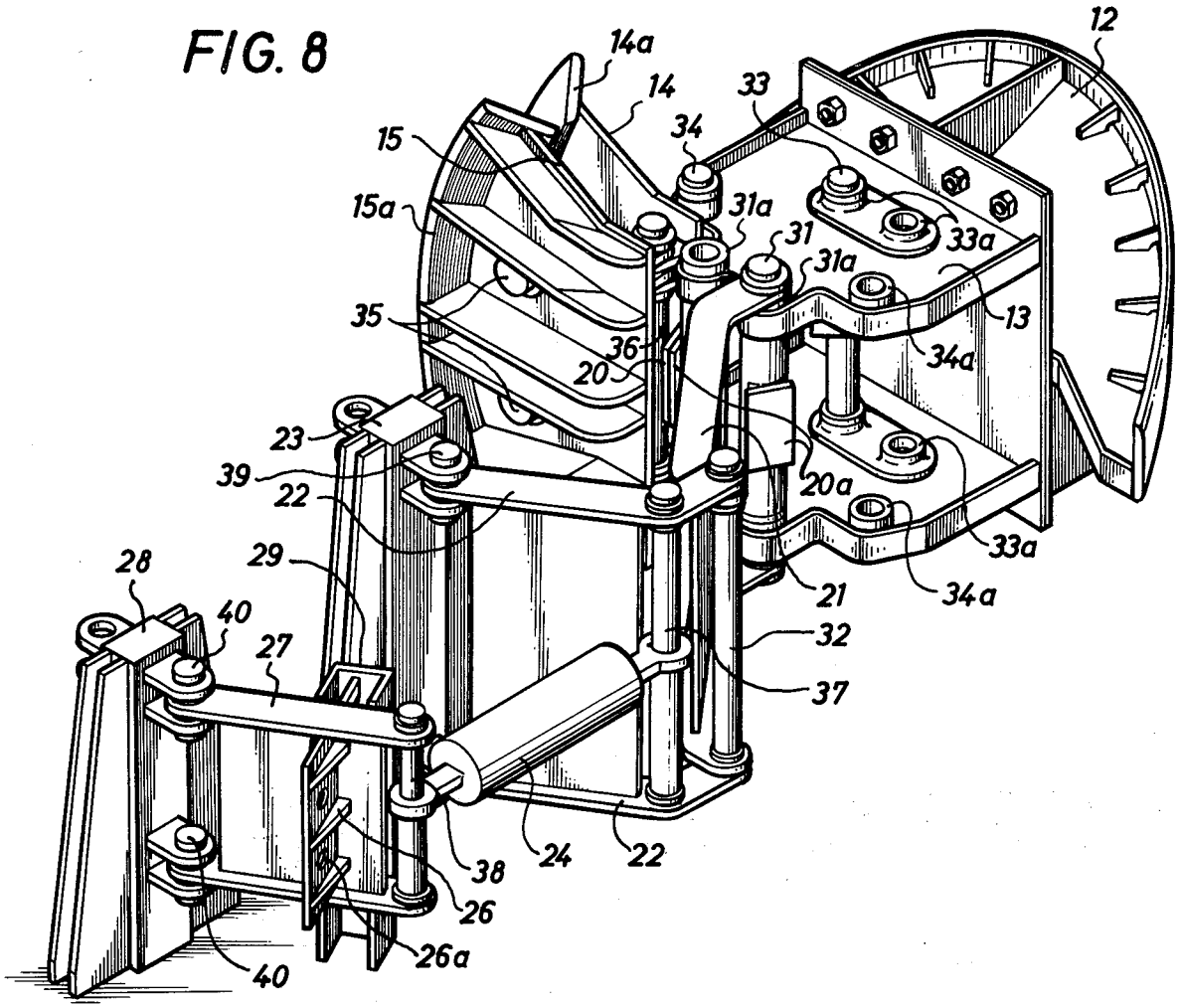
FIG. 8 is a perspective view of the coupling mechanism in which the boss and the guide fender are fully shown, but only the lefthand half of the coupling arm and only the righthand halves of the buffer leg and the retraction leg are shown.
Figure 9:
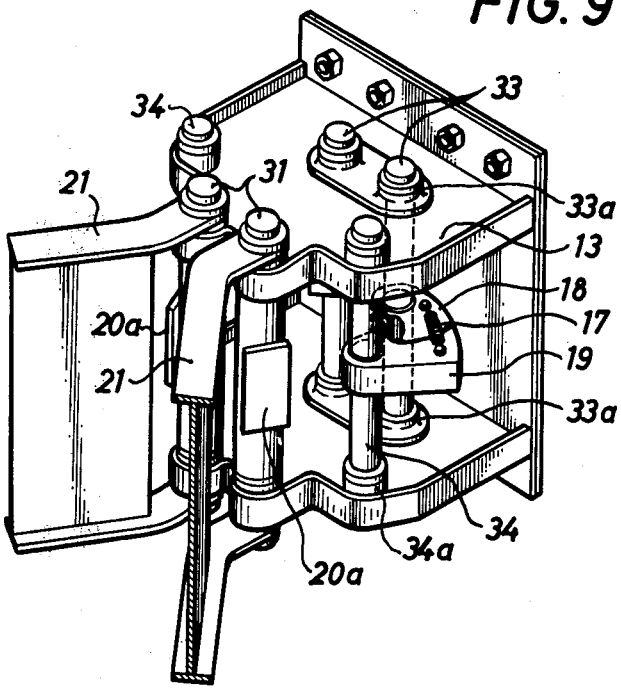
FIG. 9 is a perspective view showing the relationship between the boss and various shafts supported thereby.

Referring now to FIGS. 5 to 9, the coupling mechanism of this invention comprises connecting arms 14 and 15 in the form of two vertical circular plates having the same diameter, cushion legs 21 and 22 which constitute a portion of a cushion mechanism and retractable legs 26. These members are provided symmetrically on both sides of a guard fender 12 provided in front of a boss 13 formed at the bow of the pusher tug, and a stanchion 23 provided on the rear side of the boss to be slidable in the axial direction of the tug. Cylindrical connecting rods 11 are secured on both sides of the stern of a barge, not shown. The connecting rods are spaced to accommodate the guard fender 12 therebetween. As shown in FIG. 8, on the outer ends of connecting arms 14 and 15 are formed conical contact members 14*a* and 15*a* which are confronting with each other at right angles. As shown in FIG. 5, immediately before coupling, contact member 14*a* is positioned within the width of the guard fender 12 whereas contact member 15*a* is on the outside of the width. The inner ends of the connecting arms 14 and 15 are connected to a pivot shaft 36, and as shown in FIG. 8 two connecting pins 35 extending in the direction perpendicular to the pivot shaft 36 extend through the outer ends of the connecting arms 14 and 15. Coil springs 16 are provided for the connecting pins 35 to urge connecting arms 14 and 15 toward each other. The connecting arm 14 is mounted on the boss 13 by a shaft 34 parallel to pivot shaft 36.

Where the coupling mechanism of this invention is applied to a relatively small tug and barge, spring 16 can provide the desired cushion effect so that the cushion mechanism comprising cushion legs 21 and 22 and a cylindrical resilient member 24 may be omitted, thus simplifying the construction. The shaft 34 for the connecting arm 14 is provided with a dove-tail shaped stop member 19 and another stop member 20 extending in a direction opposite to the stop member 19. The stop members 19 and 20 are formed as an integral unit. The boss 13 is provided with another shaft 33 in parallel with shaft 34 and the shaft 33 is provided with a dove-tail shaped stop member 18 to cross the stop member 19. A tension spring 17 is provided between the stop members 18 and 19. A stop member 20*a* is mounted on shaft 31 which connects the cushion lever 21 to the boss 13 for cooperating with the stop member 20. The other end of the cushion lever 21 is pivotally connected to one end of the cushion lever 22. The other end of cushion lever 22 is pivotally connected, by a pivot pin 39, to a stanchion 23 (FIG. 8) slidably mounted on the axis of the tug together with the boss 13. In the illustrated embodiment which is designed for use in relatively large tug and barge, a pivot shaft 37 is provided for one end of the cushion leg 22 in the form of a crank arm and a cylindrical resilient member 24 (a cylinder containing a spring) is connected between the pivot shaft 37 and a pin 38 at one end of the retractable leg 27. This cylindrical resilient member 24 constitutes the principal cushion mechanism together with the cushion legs 21 and 22 which is desirable where the invention is applied to a relatively large tug and barge. As the cylindrical resilient member 24 may be used spring means including single or concentric springs or an oil pressure cylinder. The other end of the retractable leg 27 is pivotally connected by a pivot pin 40 to a stanchion 28 also slidable in the axial direction of the tug. The tug is provided with another two holding stanchions 29 and 30 at positions shown in FIGS. 5–7 for cooperating with a fitting 26 mounted on the retractable leg 27 to hold it in the operated position and retracted position. The retractable leg 27 is maintained at either one of these positions by inserting a toggle pin 41 through openings 26*a* of the fitting 26 and opening 29*a* or 30*a* of the stanchion 29 or 30. Boss 13 is provided with bearing studs 31*a*, 33*a* and 34*a* for journalling shafts 31, 33 and 34, respectively.

The coupling mechanism described above operates as follows. As the pusher tug 1 approaches, the connecting rods 11 of the barge 3 are pushed by the guard fender 12 to the position shown in FIG. 5 so that the connecting rods 11 are received in the groove between contact members 14*a* and 15*a* which are mounted on the peripheries of the connecting arms 14 and 15 to form a V shaped groove. As the tug is advanced further, the connecting arms 14 and 15 rotate about the connecting shaft 34 to the positions shown in FIG. 6. In this state, stop member 20 engages stop member 20*a* to prevent connecting arms 14 and 15 from further rotating in the clockwise direction. Since the dove-tail shaped stop member 19 is integral with the connecting arm 14, they rotate about shaft 33 until the outer end of the dove-tail shaped stop member 18 is caused to engage the curved surface at one side of the stop member 19 by the action of spring 17 interconnecting stop members 18 and 19 as shown in FIG. 6. Under these conditions, the connecting arms 14 and 15 are prevented from rotating in the clockwise direction, whereby the tug and the barge are positively coupled together while the connecting rods 11 are clamped between contact members 14*a* and 15*a*, which are slightly separated, against the force of spring 17, as shown in FIG. 6.

To separate the tug from the barge the tug is moved in a direction to pull it away from the barge. At the same time, the oil pressure cylinder 24 is operated to rotate the dove-tail shaped stop member 18 about shaft 33 in the counterclockwise direction from the position shown in FIG. 6 to the position shown in FIG. 5. Thus, the connecting arms 14 and 15 are returned to their original positions, thus disengaging the coupling.

When the tug and barge are coupled together there occur six relative motions as above described, but these problems can be solved in the following manner:

Heaving:

In the coupled state, the connecting levers 11 of the barge are clamped between contact members 14*a* and 15*a* of the connecting arms 14 and 15. When a force larger than static frictional force acts upon these elements, the connecting rods 11 are moved relative to the contact members 14*a* and 15*a* thus avoiding heaving.

Rolling:

When a rotary force larger than the static frictional force acts between the connecting rods 11 and the contact members 14*a* and 15*a* of the connecting arms a relative rotation occurs between the connecting rods 11 and the contact members 14*a* and 15*a* thus preventing rolling.

Pitching:

Since the connecting arm 15 is pulled toward the other connecting arm 14 by the spring 16 in a perfectly coupled condition, when a force larger than the force of the spring 16 is applied by the pitching the connecting arm 15 is rotated about the pivot pin 36 by compressing spring 16, thus preventing the pitching.

Yawing:

When yawing occurs the left and righthand cushion legs rotate about their connecting shafts 32 so as to change a line interconnecting the axis of the left and righthand shafts 31. Accordingly, the set angle of the boss will vary. The relative swing angle can readily be determined by detecting the change of the line interconnecting left and righthand shafts 31. The relative swing angle thus detected is sent to a steering chamber and utilized to control the rudder angle, thus assuring safe sail.

Surging:

For the purpose of absorbing the shock which occurs at the time of coupling, a strong cylindrical resilient member 24 is interposed between the cushion leg 22 and the retractable leg 27 so that when a large force is applied to the boss in the longitudinal direction thereof the legs 21 and 22 are separated or brought close with the result that the cylindrical resilient member 24 connected to the outer ends of the legs 21 and 22 is elongated or contracted, thus alleviating the shock.

Swaying:

When a large force is applied in the lateral direction, the angle formed between the cushion legs 21, 22 on one side of the tug decreases and simultaneously increases on the other side. The connecting point 37 on one side of the longitudinal axis of the tug compresses the cylindrical resilient member 24 while the connecting member on the other side elongates the cylindrical resilient member 24 on that side, thereby alleviating the shock.

The retractable leg 27 and the holding stanchions 29 and 30 are used in the following manner. More particularly, during operation of the coupling mechanism of this invention, the leg 27 is held in the position shown in FIGS. 5 and 6 by inserting the toggle pin 41 into the openings of the fitting 26 and the stanchion 41, whereas in the inoperative position, the cushion leg 22 and the retractable leg 27 are rotated toward the longitudinal axis of the tug and the leg 27 is held by the holding stanchion 30 as shown in FIG. 7 by inserting the toggle pin 41 into the openings of the fitting 26 and stanchion 30.

In the embodiment described above, connecting rods 11 are secured to the barge and the connecting rod receiving means is mounted on the tub. However, it will be clear that it is possible to secure the connecting rods to the tug and to mount the connecting rod receiving means of the coupling mechanism on the barge. But since the number of barges is greater than that of the tugs, the former arrangement is preferred.

As above described there is provided an improved coupling mechanism between a pusher tug and a barge which is simple in construction and does not use any rigging. Accordingly, it is not necessary to install winches and pulleys and it is possible to readily couple together a barge and tug. Thus, the coupling mechanism of this invention is suitable for large tugs and barges. Moreover, the coupling mechanism of this invention can readily prevent or alleviate displacements caused by heaving, rolling, pitching and yawing created by the relative movements between the tug and the barge. Thus, the coupling mechanism of this invention is resistant to waves. Moreover, as it is possible to readily detect the relative swing angle between the tug and the barge it is possible to correctly steer and tug by using the detected swing angle.

Although the invention has been shown and described in terms of a preferred embodiment thereof, it should be understood that the invention is not limited to this specific embodiment and that many changes and modifications are obvious to one skilled in the art without departing the true spirit and scope of the invention as defined in the appended claim.

What is claimed is:

1. A coupling mechanism for coupling together a pusher tug and a barge comprising:

a pair of spaced connecting rods secured to the opposite sides of one end of either one of said tug and barge, and a pair of connecting rod receiving means mounted on respective opposite sides of one end of the other of said tug and barge for respectively receiving and slideably engaging said connecting rods, each of said receiving means including:

two substantially vertical members, each of said vertical members having a vertically arranged peripheral portion which is substantially in the shape of an arc of a circle in a substantially vertical plane, the diameter of which is smaller than the spacing between said connecting rods;

means for coupling said vertical members together so that one of said vertical members is movable relative to the other to vary the spacing therebetween;

means for rotatably supporting said vertical members relative to said other of said tug and barge;

at least two separate contact members respectively secured to the peripheries of said vertical members and being curved in the vertical direction to substantially conform to said circular arc shape of said vertical member, said curved contact members being arranged to form a generally V-shaped groove therebetween for receiving and slidably engaging a connecting rod in said V-shaped groove such that said connecting rod is slidable at least in the vertical direction relative to said contact members when said connecting rod is received and engaged in said generally V-shaped groove, each of said curved contact members being arranged to make substantially point contact with an engaged connecting rod;

urging means for resiliently urging said vertical members and their associated contact members toward each other, said vertical members being rotatable relative to each other against said urging means under the influence of pressure exerted by a received connecting rod to widen the spacing between said vertical members in order to widen the spacing between said contact members, thereby widening said generally V-shaped groove; and stop members for limiting the rotational movement of said vertical members, whereby said vertical members are rotatable against the force of said urging means over a predetermined range.

2. The coupling mechanism according to claim 1 wherein said connecting rods are secured to the stern of the barge and said connecting rod receiving means is mounted on the bow of said pusher tug.

3. The coupling mechanism according to claim 1 wherein each of said connecting rod receiving means further comprises a guard fender having a width smaller than the spacing between said connecting rods, a boss mounted on the longitudinal axis of said tug or barge on which said connecting rod engaging means are mounted, a first cushion leg having one end pivotally connected to said boss, a second cushion leg having one end pivotally connected to the other end of said first cushion leg, and a stanchion pivotally connected to the other end of said second cushion leg and slidably mounted along said longitudinal axis.

4. The coupling mechanism according to claim 3 wherein each of said connecting rod receiving means further comprises an additional stanchion slidably mounted along said longitudinal axis, a retractable leg having one end pivotally connected to said additional stanchion, and resilient means connected between the other end of said retractable leg and one end of said second cushion leg.

5. The coupling mechanism according to claim 4 wherein each of said connecting rod receiving means further comprises holding stanchions for holding said retractable leg in the operated position or retracted position.

6. The coupling mechanism according to claim 3 wherein each of said connecting rod receiving means further comprises a first pivot shaft mounted on said boss for rotatably supporting one of said vertical members, a first generally dove-tail shaped stop member mounted on said pivot shaft for limiting the rotational movement in one direction of said connecting rod receiving means, a second pivot shaft mounted on said boss, a second generally dove-tail shaped stop member mounted on said second pivot shaft, and a spring connected between said first and second stop members for causing them to engage with each other.

7. The coupling mechanism according to claim 6 wherein said spring connected between said first and second stop members comprises a tension spring.

8. The coupling mechanism according to claim 3 wherein each of said connecting rod receiving means further comprises a third stop member supported by said boss for limiting the rotational movement of said connecting rod receiving means, and a fourth stop member mounted on said boss for cooperating with said third stop member.

9. The coupling mechanism according to claim 1 wherein each of said connecting rod receiving means further comprises pins extending through the peripheral portions of said vertical members, and spring means surrounding said pins for urging said vertical members toward each other.

10. The coupling mechanism according to claim 1 wherein said vertical members are plate members.

11. The coupling mechanism according to claim 1 wherein said vertical members are vertically arranged part-circular disc members.

12. The coupling mechanism according to claim 1 wherein said resilient urging means comprises spring means.

* * * * *